US005539510A

United States Patent [19]

Yamashiro et al.

[11] Patent Number: 5,539,510

[45] Date of Patent: Jul. 23, 1996

[54] IMAGE FORMING APPARATUS HAVING A ROTATING DETECTION LEVER OPERABLE IN VERTICAL AND HORIZONTAL POSITIONS

[75] Inventors: Kunio Yamashiro; Masanori Ueda, both of Kawasaki, Japan

[73] Assignee: Fujitsu Limited, Kawasaki, Japan

[21] Appl. No.: 277,991

[22] Filed: Jul. 20, 1994

[30] Foreign Application Priority Data

Sep. 24, 1993 [JP] Japan ..... 5-261603

[51] Int. Cl.[6] ..... G03G 21/00

[52] U.S. Cl. ..... 355/309; 355/208; 355/308

[58] Field of Search ..... 355/208, 308, 355/309, 316, 317, 321, 323; 271/264, 242

[56] References Cited

U.S. PATENT DOCUMENTS

| | | | |
|---|---|---|---|
| 4,684,235 | 8/1987 | Kohmoto et al. | 355/316 |
| 4,990,011 | 2/1991 | Underwood et al. | 271/242 X |
| 5,141,222 | 8/1992 | Sawada et al. | 355/323 X |
| 5,171,145 | 12/1992 | Kusaka et al. | 432/59 |
| 5,277,415 | 1/1994 | Kinoshita et al. | 271/242 |

FOREIGN PATENT DOCUMENTS 61-128264 6/1986 Japan .

*Primary Examiner*—Sandra L. Brase

*Attorney, Agent, or Firm*—Armstrong, Westerman, Hattori, McLeland & Naughton

[57] ABSTRACT

Disclosed is an image forming apparatus capable of operating to form an image both in a horizontal installation of the apparatus and in a vertical installation thereof. The apparatus comprises a rotary endless latent image carrier; a latent image forming unit for forming a latent image on the latent image carrier; a developing unit for developing the latent image on the latent image carrier with a powder developer; and a transferring unit for transferring the developed image on the latent image carrier onto a sheet fed via a feeding path. The apparatus further comprises; a sheet detecting unit having a detection lever rotating about a rotary shaft, with a line connecting a center-of-rotation to a center-of-gravity being set at 40° through 50° with respect to a direction-of-gravity, and a detecting element for detecting the detection lever. With this construction, the sheet to be fed can be detected by the mechanical lever even in the horizontal installation state of the apparatus and in the vertical installation state thereof.

25 Claims, 13 Drawing Sheets

FIG.1A
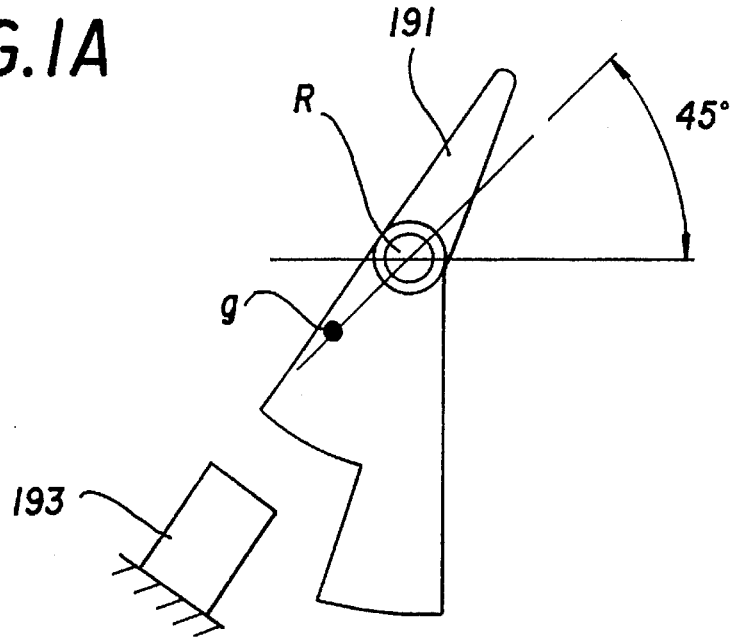
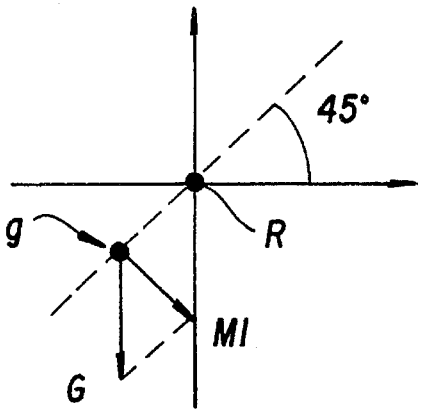
FIG.1B
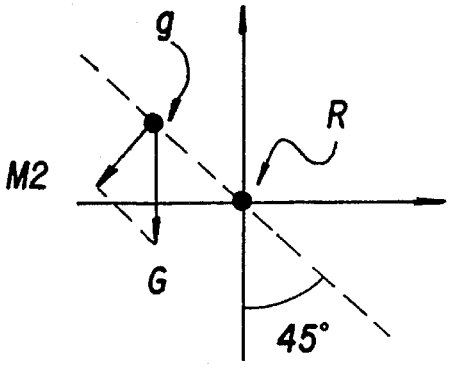
FIG.1C

IMAGE FORMING APPARATUS HAVING A ROTATING DETECTION LEVER OPERABLE IN VERTICAL AND HORIZONTAL POSITIONS

BACKGROUND OF THE INVENTION

1. Field of the Invention

The present invention relates to an image forming apparatus capable of operating to form an image both in a horizontal installation and in a vertical installation of the apparatus.

2. Description of the Related Art

In an image forming apparatus such as a copying machine, a printer, a facsimile, etc., a latent image forming apparatus like an electrophotographic apparatus has been utilized from a demand for recording on ordinary paper. In such an image forming apparatus, an electrostatic latent image is formed on a photosensitive drum. Next, the electrostatic latent image on this photosensitive drum is developed with a powder developer and is thereby transformed into a visible image. Further, the powder developer on the photosensitive drum is transferred onto a sheet. This sheet is separated therefrom, and the powder-developed image on the sheet is fixed.

In this type of image forming apparatus, it is desirable to make effective use of an installation space by changing an installation position of the apparatus.

FIG. 13 is a view of assistance in explaining a prior art.

In the electrophotographic apparatus, it is required that feeding of the sheet be synchronized with a position of a toner image on a photosensitive drum 90 to transfer the toner image on the photosensitive drum 90 onto the sheet. For this purpose, the sheet taken out of a sheet cassette impinges on a resist roller 91 and is thereafter fed by the resist roller 91 in synchronism with the toner image on the photosensitive drum 90.

A sheet detector 8 is provided for detecting that the sheet reaches this resist roller 91. In general, this sheet detector 8 involves the use of a known photosensor. In the image forming apparatus, however, the toners are easy to scatter within the apparatus. For this reason, the scattered toners are adhered to the photosensor, resulting in a decline in terms of a performance of the sensor. Therefore, a mechanical sensor for mechanically detecting the sheet is employed.

As illustrated in FIG. 13, this type of sheet detector 8 includes a detection lever 82 secured to a rotary shaft 81 provided in a lever holding block 80. A front end of the detection lever 82 is protruded into a feeding path defined by a couple of sheet guides 93, 94. On the other hand, a transmission type sensor 83 is provided in the lever holding block 80, corresponding to a rear end of the detection lever 82. Further, the detection lever 82 is biased in a direction of the feeding path by a spring 84.

An operation of the construction shown in FIG. 13 will be explained. In a state where the sheet does not exist in the feeding path, as illustrated in FIG. 13, the rear end of the detection lever 82 does not intercept the transmission type sensor 83, and, therefore, the non-existence of the sheet can be recognized from an output of the transmission type sensor 83. On the other hand, if a leading edge of the sheet touches the front end of the detection lever 82, the detection lever 82 rotates clockwise in the FIGURE by dint of a sheet feeding force, resisting the biasing force of the spring 84. With this action, the rear end of the detection lever 82 intercepts the transmission type sensor 83, whereby reaching of the sheet can be detected. In this mechanical sensor, the biasing force of the spring 84 is set smaller than the sheet feeding force.

On the other hand, for instance, Japanese Patent Laid-Open Publication Number 4-323125 discloses an image forming apparatus which operates even when installed horizontally or vertically. This image forming apparatus aims at operating to form the image both in the horizontal installation and in the vertical installation of the apparatus.

According to the prior arts, however, first, a force of rotary moment varies depending on a position of center-of-gravity of the detection lever when the apparatus is installed vertically and when installed horizontally in the above-mentioned sheet detector. For this reason, a detection timing of the sheet differs when the apparatus is installed horizontally and when installed vertically. This conduces to an occurrence of a deviation of the transferred image because of a difference in terms of a drive timing of the resist roller.

Secondly, when attaining down-sizing of the apparatus, the above sheet detector also decreases in size. The spring constituting this detector becomes small on the order of, e.g., several mm. Accordingly, it takes a good deal of labors to attach such micro parts, resulting in an increase in costs for the apparatus.

SUMMARY OF THE INVENTION

It is a primary object of the present invention to provide an image forming apparatus for stably detecting a fed sheet even when the apparatus is horizontally installed and when vertically installed.

It is another object of the present invention to provide an image forming apparatus for preventing a transfer positional deviation of a fed sheet even when the apparatus is horizontally installed or when vertically installed.

According to one aspect of the present invention, there is provided an image forming apparatus capable of operating to form an image both in a horizontal installation of the apparatus and in a vertical installation thereof. To achieve the foregoing and other objects in accordance with the purpose of the present invention, according to one aspect of the invention, an image forming apparatus capable of performing an image forming operation in both a horizontal position and a vertical position comprises a rotary endless latent image carrier member; a latent image forming unit for forming a latent image on the latent image carrier; a developing unit for developing the latent image on the latent image carrier with a powder developer; a transferring unit for transferring the developed image on the latent image carrier onto a sheet fed via a feeding path; and a sheet detecting unit for detecting the sheet in the feeding path, said sheet detecting unit having a detection lever rotating about a rotary shaft, with a line connecting a center-of-rotation to a center-of-gravity being set at 40° through 50° with respect to a direction-of-gravity, and a detecting element for detecting the detection lever.

According to the present invention, the angle of the line connecting the center-of-rotation R of the detection lever rotating about the rotary shaft to the center-of-gravity g is set at approximately 45° with respect to the direction-of-gravity. With this setting, the rotation moment M1 when the apparatus is horizontally installed becomes substantially equal to the rotation moment M2 when the apparatus is vertically installed. Consequently, the resistance against the sheet feeding force when detecting the sheet becomes the same, and the sheet detection timing can be also set the same. Note that ±5° is taken into consideration, and accordingly the angle is set at 40° through 50° in the range where the resistance is the same.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which:

FIGS. 1A, 1B and 1C are views showing a principle of the present invention;

DETAILED DESCRIPTION OF THE PREFERRED EMBODIMENTS

FIGS. 1A, 1B and 1C are views illustrating a principle of the present invention.

As seen in a configuration of a sheet detector of FIG. 1A, an angle of a line connecting a center-of-rotation R of a detection lever 191 rotating about a rotary shaft to a center-of-gravity g of the detection lever 191 is set at approximately 45° with respect to the direction-of-gravity.

FIG. 1B is a view showing a rotation moment of the detection lever 191 when an apparatus is horizontally installed. FIG. 1C is a view showing a rotation moment of the detection lever 191 when the apparatus is vertically installed.

With this arrangement, as illustrated in FIG. 1B, a rotation moment M1 when the apparatus is horizontally installed is, as shown in FIG. 1C, substantially equal to a rotation moment M2 when installed vertically. A resistance against a sheet feeding force when detecting the sheet consequently becomes uniform, and, therefore, a sheet detection timing can be set the same.

For this reason, the sheet is detectable at the same timing both in the horizontal installation and in the vertical installation. Further, this eliminates the necessity for a micro restoration spring. The above angle is theoretically desirably 45°. However, ±5° is considered in a range where the resistance is the same, and accordingly the angle is set at 40° through 50°.

Figure 2:
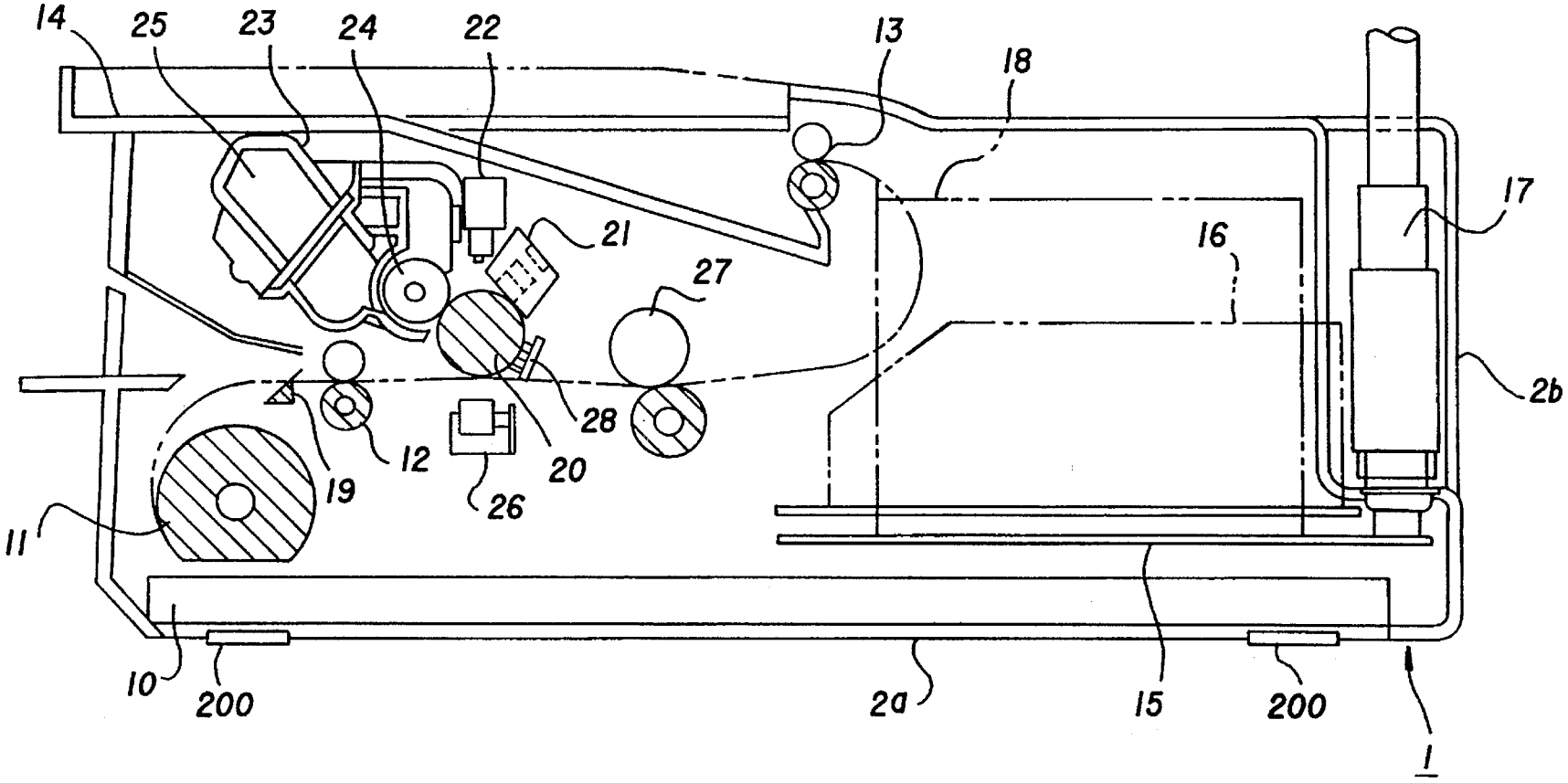
FIG. 2 is a view illustrating a construction of an image forming apparatus in one embodiment of the present invention.
Figure 3:
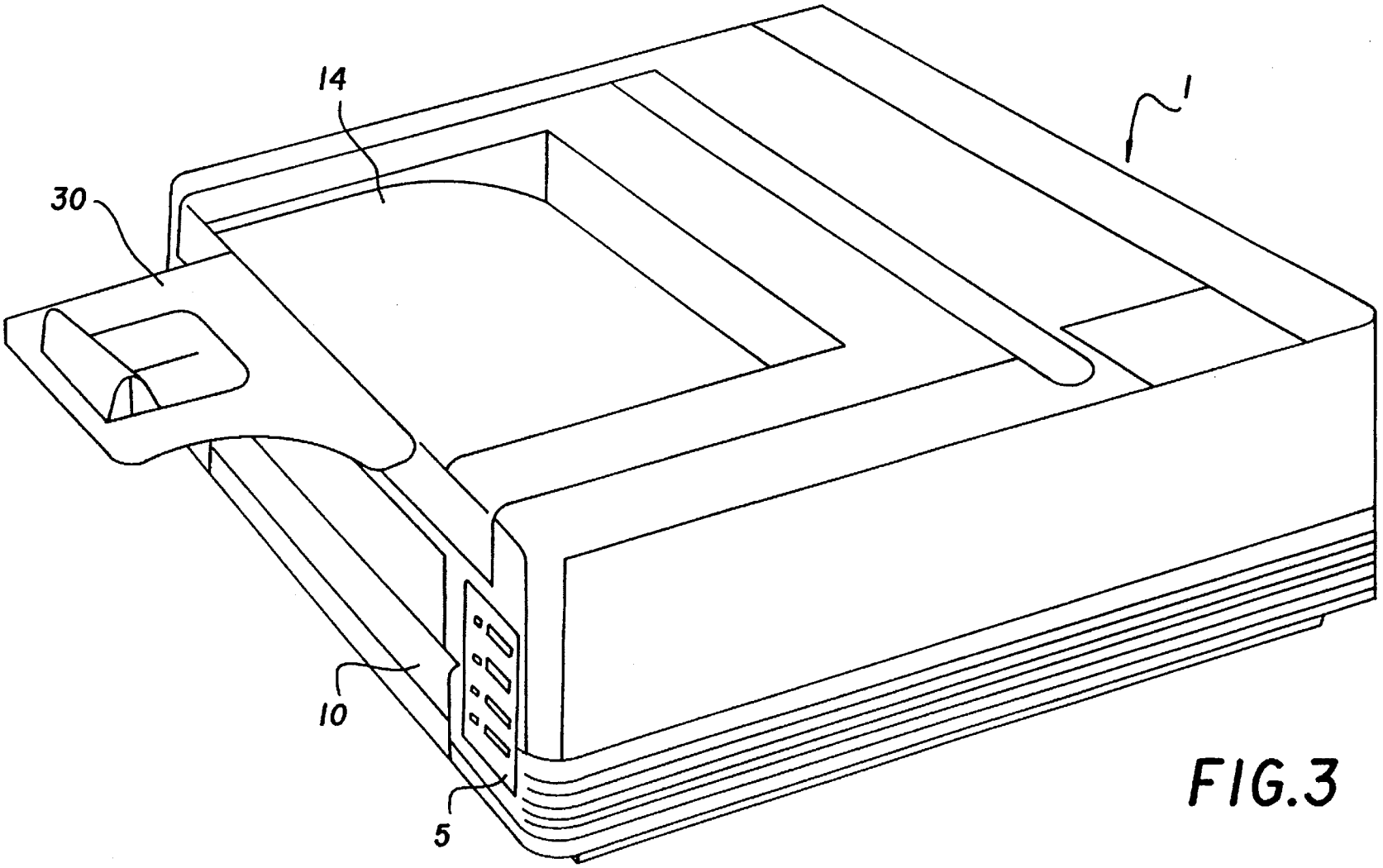
FIG. 3 is a view showing a state of horizontal installation of the apparatus of FIG. 2.
Figure 4:
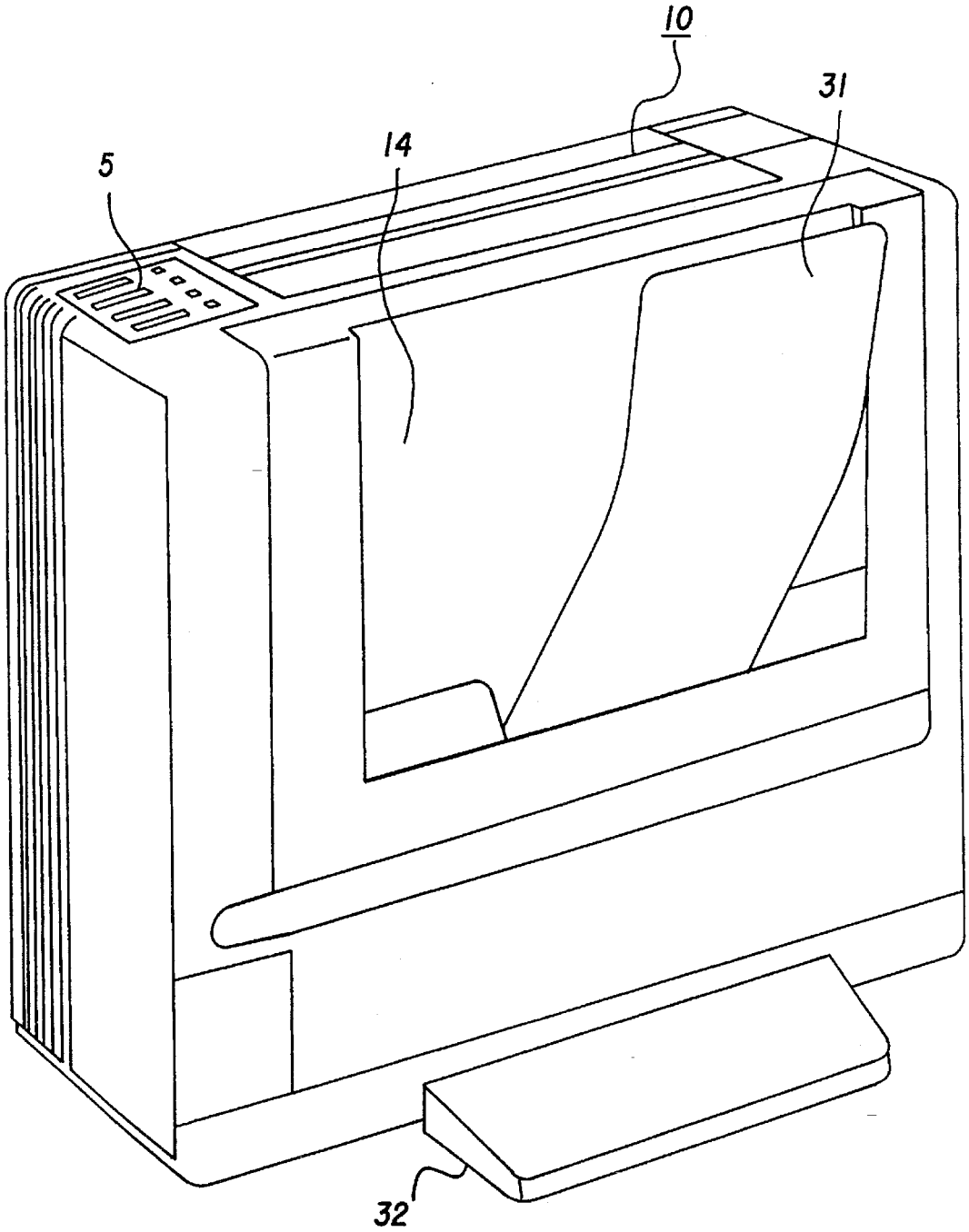
FIG. 4 is a view showing a state of vertical installation of the apparatus of FIG.

FIG. 2 is a view illustrating a construction of an image forming apparatus in one embodiment of the present invention. FIG. 3 is a view showing,a state where the apparatus of FIG. 2 is horizontally installed. FIG. 4 is a view showing a state where the apparatus of FIG. 2 is vertically installed. This image forming apparatus is shown in the form of an electrophotographic printer.

As illustrated in FIG. 2, a photosensitive drum 20 is constructed such that a functional separation type organic photosensitive body is coated about 20 microns thick on an aluminum drum. A major diameter thereof is 24 mm. The photosensitive drum 20 rotates counterclockwise as indicated by an arrowhead at a peripheral speed of 25 mm/s. A precharger 21 is a non-contact type charger constructed of a Scolotron. Then, the precharger 21 uniformly charges the surface of the photosensitive drum 20. The precharger 21 charges the surface of the photosensitive drum 20 with −580 V.

An optical unit 22 performs an image-exposure on the uniformly charged photosensitive drum 20, thereby forming an electrostatic latent image on the photosensitive drum 20. This optical unit 22 involves the use of an LED optical system composed of a combination of an LED array and a self-focus lens array. The image-exposure by this optical unit 22 serves to form the electrostatic latent image of −50 to −100 V on the photosensitive drum 20.

A developing unit 23 supplies charged toners to the electrostatic latent image on the photosensitive drum 20 and transforms it into a visible image as will hereinbelow be stated in FIG. 5. A developing roller 24 of the developing unit 23 feeds a developer to the photosensitive drum 20. A toner cartridge of the developing unit 23 is filled with magnetic toners. This toner cartridge 25 is exchangeably attached to the developing unit 23. The toner cartridge 25 is replaced when in a state of toner empty to replenish the developing unit 23 with the magnetic toners.

A transfer unit 26 is constructed of a corona discharger. This transfer unit 26 electrostatically transfers the toner image formed on the photosensitive drum 20 onto a sheet. More specifically, a voltage on the order of +3 kV to +6 kV is applied to a corona wire from a power source, thereby generating an electric charge through the corona discharging. A rear surface of the sheet is thus electrified to transfer the toner image on the photosensitive drum 20 onto the sheet P. This power supply is desirably a constant-current power supply capable of reducing a drop of a transfer efficiency depending on environments by supplying the sheet with a fixed amount of electric charges.

A fixing unit 27 is constructed of a heat roller incorporating a halogen lamp serving as a heating source and a pressurizing roller (a back-up roller). Then, the sheet is heated up, thereby fixing the toner image onto the sheet.

A dispersion (uniformizing) brush 28 is constructed of a conductive brush. This dispersion brush 28 contacts the photosensitive drum 20 and thereby decentralizes the toners left on the photosensitive drum 20. With this dispersion, the residual toners of the developing unit 23 can be easily collected.

Further, an AC voltage is applied to this dispersion brush 28, thereby removing the residual toners off the photosensitive drum 20. Besides, reciprocative motions to return them once again are thereby produced. With this operation, the residual toners can be properly dispersed. Moreover, there is an effect of de-electrifying the photosensitive drum 20 by applying a voltage larger than a start-of-discharging voltage. A positive after-image due to the residual electric charges is eliminated.

As illustrated in FIG. 2, a sheet cassette 10 for housing the sheets is detachably attached to the apparatus. This sheet cassette 10 is provided in a lower portion of the apparatus. The sheet cassette 10 can be attached to and detached from the front surface of the apparatus on the left side of the Figure. A pick roller 11 serves to pick the sheet in the sheet cassette 10. A resist roller 12 receives an impingement of the picked sheets, thus aligning the leading edges of the sheets and, thereafter, feeds the sheets to the transfer unit 26. A sheet discharge roller 13 works to discharge the sheet after being fixed to a stacker 14. The stacker 14 mounted on the upper surface of the apparatus stacks the sheets discharged.

A printed circuit board 15 is mounted with a control circuit of the apparatus. A power supply 16 supplies each element of the apparatus with the electric power. An I/F (interface) connector 17 connected to an external cable is inserted into the apparatus and connected to a connector of the printed circuit board 15. An option board 18 is mounted with a different type of emulator circuit, a font memory, etc.

A sheet detector 19 is provided in front of the resist roller 12 on the feeding path. This sheet detector 19 detects that the sheet picked by the pick roller 11 reaches the resist roller 12 as will hereinafter be stated in FIG. 10.

A bottom surface 2*a* of the apparatus is provided with four pieces of support rubbers. This bottom surface 2*a* functions as an installation surface when the apparatus is horizontally installed. Further, a side surface 2*b* of the apparatus functions as an installation surface when the apparatus is vertically installed.

The operation of this embodiment will be explained. A Scolotron charger 21 uniformly charges the surface of the photosensitive drum 20 with −580 V. Thereafter, an image-exposure is effected by an LED optical system 22. With this processing, the photosensitive drum 20 is formed with an electrostatic latent image with a background portion of −580 V and a printing portion of −50 V to −100 V. A developing bias voltage (−450 V) is applied to a sleeve 241 (which will hereinbelow mentioned in FIG. 5) of the developing roller 24 of the developing unit 23. As a result of this, the electrostatic latent image on the photosensitive drum 20 is developed by the developing unit 23 with magnetic polymerized toners which are minus-charged beforehand by stirring with carriers. The electrostatic latent image thus turns out a toner image.

On the other hand, the sheet is picked by the pick roller 11 out of the sheet cassette 10. The sheet is detected by the sheet detector 10 on this side of the resist roller 12. The leading edges of the sheets are aligned by the resist roller 12. Thereafter, the sheets are fed toward the transfer unit 26 by a drive of the resist roller 12, which is based on an output of the above-described sheet detector 19. Then, the toner image on the photosensitive drum 20 is transferred onto the sheet by the transfer unit 26 with the electrostatic force. This toner image on the sheet is fixed thereto by the fixing unit 27. The sheet passes through a U-shaped feeding path and discharged to the stacker 14 by the sheet discharge roller 13.

On the other hand, a transfer rate of the toner image onto the sheet is not 100%, but some toners remain on the photosensitive drum 20. A method of removing the residual toners involves the use of a known cleanerless process in which a cleaner is eliminated (e.g., [The Cleanerless Laser Printer Using One-Component Non-Magnetic Phenomenon System] or the like, reported on pp.293–301, 3rd Issue, Vol.30 in the Article Collection compiled by The Association of Electrophotography).

In this cleanerless process, the cleaner is eliminated, and the untransferred residual toners are collected by the developing unit 23. Thus, the untransferred residual toners are reused for printing. In the cleanerless process, the cleaner is eliminated, and, instead, a conductive uniformizing brush 28 is provided.

In this recording process, the dispersion (uniformizing) brush 28 disperses the untransferred residual toners on the photosensitive drum 20. Subsequently, thereafter, the corona charger 21 effects uniform charging in a state where the toners are adhered onto the photosensitive drum 20. The optical unit 22 performs the image-exposure, and the developing unit 23 conducts the development simultaneously with the collection of the untransferred residual toners.

This uniformizing brush 28 disperses the toners concentrated on a local area. With this dispersion, a toner quantity per unit area is reduced, thereby making easier the collection by the developing unit 23. Further, the residual toners are prevented from being a filter of ion shower of the corona charger 21. As a result, the charging is prevented from being ununiform. Besides, the residual toners are prevented from being the filter in the image exposure process. This provides an effect of restraining the exposure from being ununiform.

A point of this recording process is that the toners on the photosensitive drum 20 are collected simultaneously with the developing process. This will be exemplified by such a manner that both of the photosensitive drum 20 and the toners undergo minus-charging. An electric potential on the surface of the photosensitive drum 20 is set to −580 V by the charger 21. An exposure portion where the electric potential is decreased due to the image exposure forms an electrostatic latent image with a drop of the electric potential down to 0 V−-several 10 V. A developing bias voltage (e.g., −450 V) which is substantially intermediate between the surface potential and the latent image potential is applied to the developing roller 24 of the developing unit 23 during the developing process.

In the developing process, the minus-charged toners adhered onto the developing roller 24 are stuck to the electrostatic latent image on the photosensitive drum 20 by dint of an electric field formed by the developing bias and the latent image potential, thereby forming the toner image. In the cleanerless process, simultaneously with this developing process, the untransferred residual toners dispersed on the photosensitive drum 20 in the uniformizing process by the dispersion brush 28 are collected by the developing roller 24 from on the photosensitive drum 20 with the electric field formed by the surface potential of the photosensitive drum 20 and the developing bias.

This cleanerless process has the following advantages: (1) the necessity for a mechanism for disposing of toners is eliminated, resulting in the down-sizing of the apparatus; (2) a space for storing the disposal toners is not required; (3) the toners contributing to printing disappear, and, this is therefore economical; (4) the toners are not disposed of, and hence this conforms to the protection of the environment; and (5) removing the toners from the photosensitive drum with the cleanser involves omitting the photosensitive drum with the cleaner, however, a life-span of the photosensitive drum increases because of using no cleaner.

The remarkable down-sizing of this apparatus can be attained for the reason of employing no cleaner and so on. The apparatus is also easy for installation on the disk in the form of a printer for personal use. Further, as illustrated in FIG. 3, the sheet cassette 10 can be placed horizontally to the installation surface. That is, the bottom surface 2*a* of the apparatus serves as the installation surface.

Referring again to FIG. 3, an operation panel 5 displays a state of the apparatus and is, at the same time, intended to indicate an operation to the apparatus. A sheet guide 30 is provided at a front edge of the stacker 14. This sheet guide 30 holds the leading edges of the sheets discharged to the-stacker 14 and exhibits an effect of aligning the leading edges thereof. In accordance with this embodiment, the sheet cassette 10 can be attached to and detached from the front surface of the apparatus. Further, the discharge sheets are also discharged from the front surface of the apparatus.

Moreover, as depicted in FIG. 4, it is possible to attain the vertical installation wherein the installation surface thereof is set on the side of the I/F connector 17 (the side surface 2*b*) of the apparatus shown in FIG. 2. That is, the image can be formed with the vertical installation in which the sheet cassette 10 is perpendicular to the installation surface. This installation makes the installation area smaller than before.

At this time, a sheet holder 31 for holding the sheets discharged to the stacker 14 to prevent the sheets from falling down. The sheets can be thereby prevented from falling down even when placed vertically. Further, a stand 32 is provided on the side of the installation surface of the apparatus, with the result that the apparatus can be stably placed even with the vertical installation.

In addition, even when employing the cleanerless process, the precharger 21 and the transfer unit 26 are constructed of the non-contact type dischargers, and, therefore, the toners on the photosensitive drum 20 are not adhered to these units. Consequently, the uniform charging and transferring can be stably executed.

Figure 5:
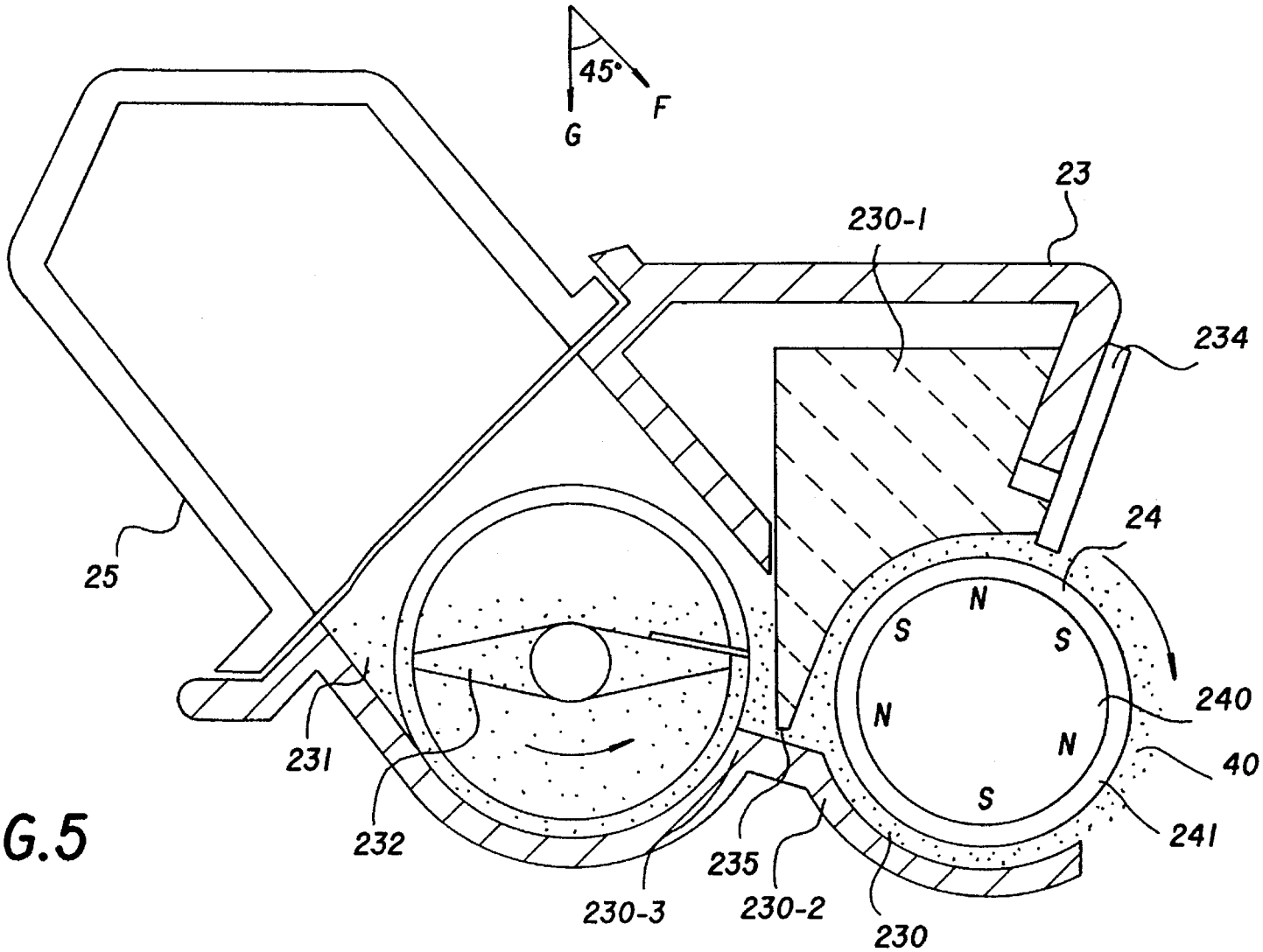
FIG. 5 is a view illustrating a configuration of a developing unit of FIG. 2.
Figure 6:
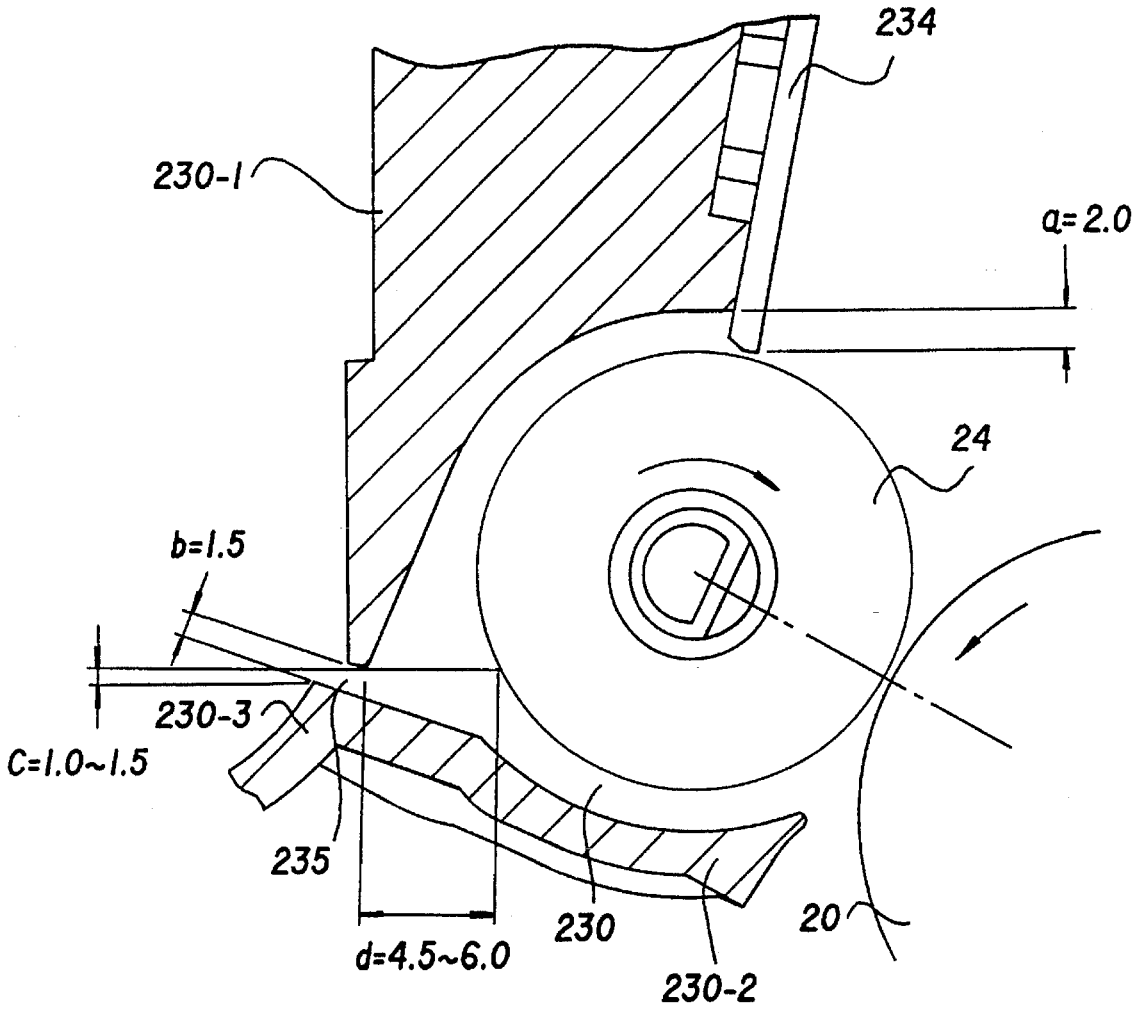
FIG. 6 is a sectional view showing the principal elements of developing unit of FIG, 5.
Figure 7:
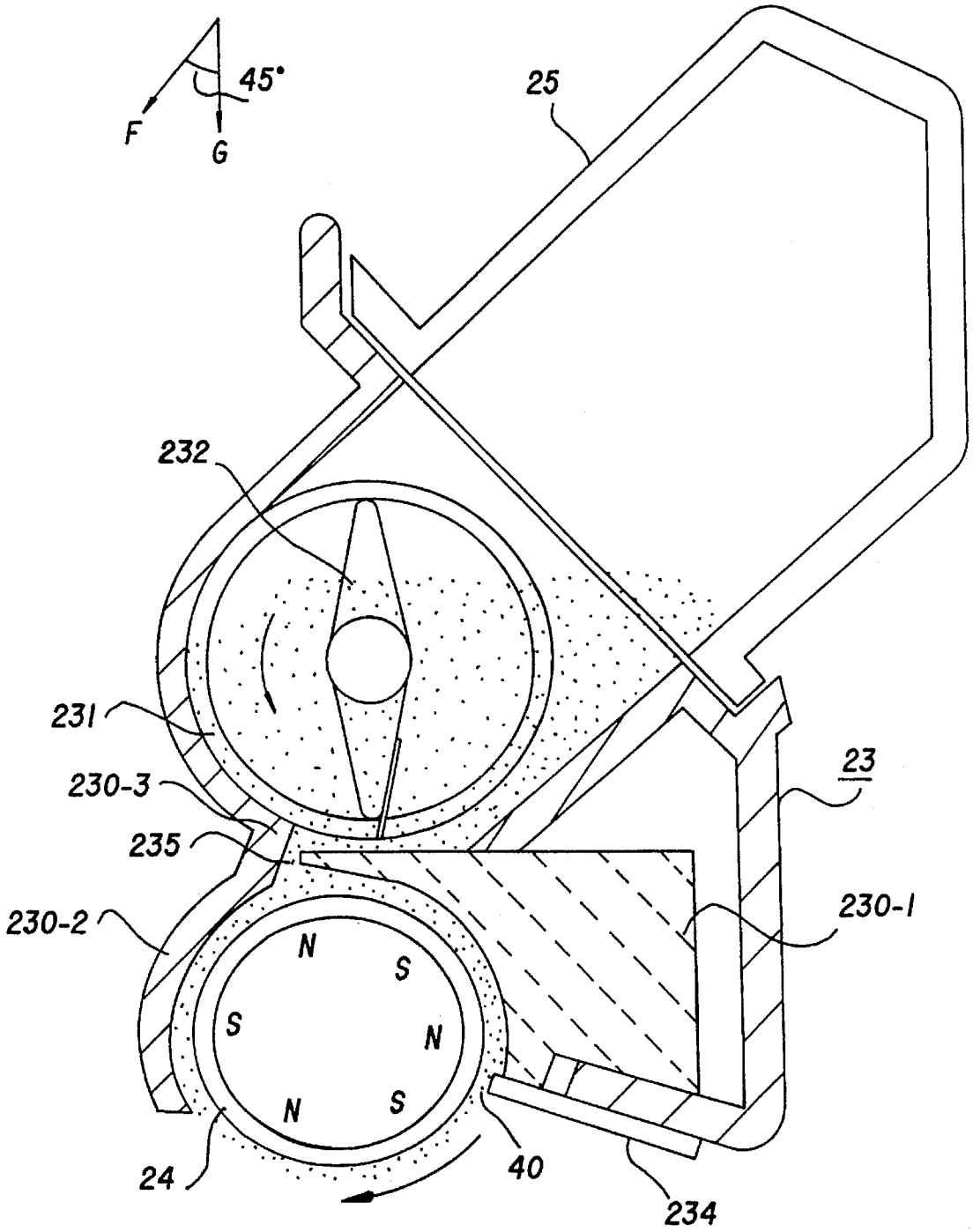
FIG. 7 is a view showing a state of vertical installation the developing unit of FIG. 2.
Figure 8A:
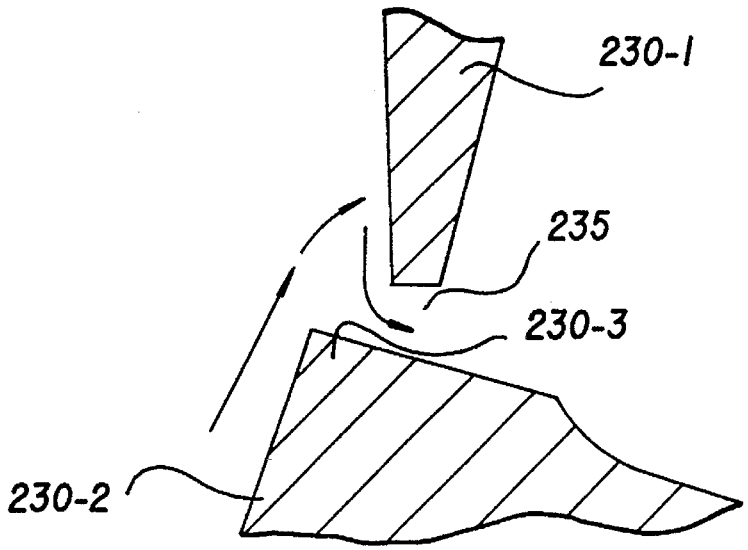
FIGS. 8A and 8B are views of assistance in explaining a flow of supply toners according to this invention.
Figure 8B:
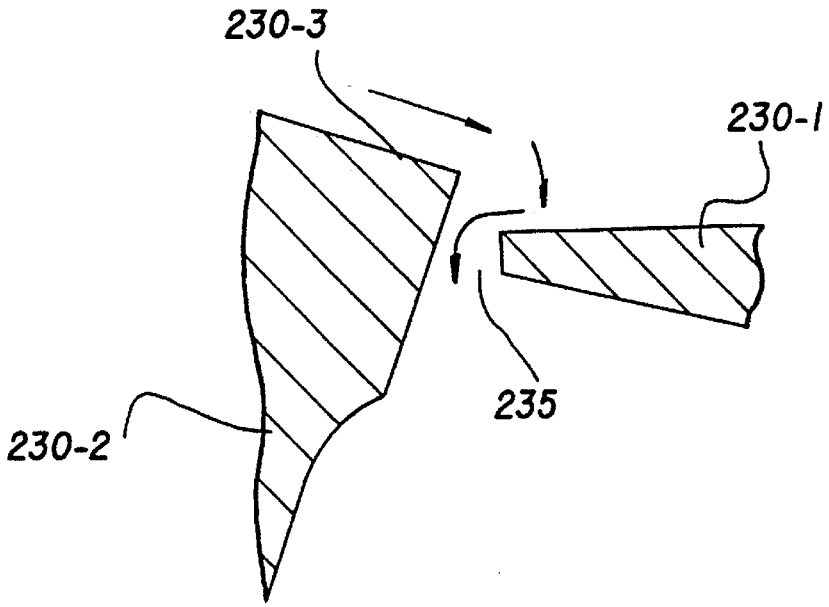
Figure 9:
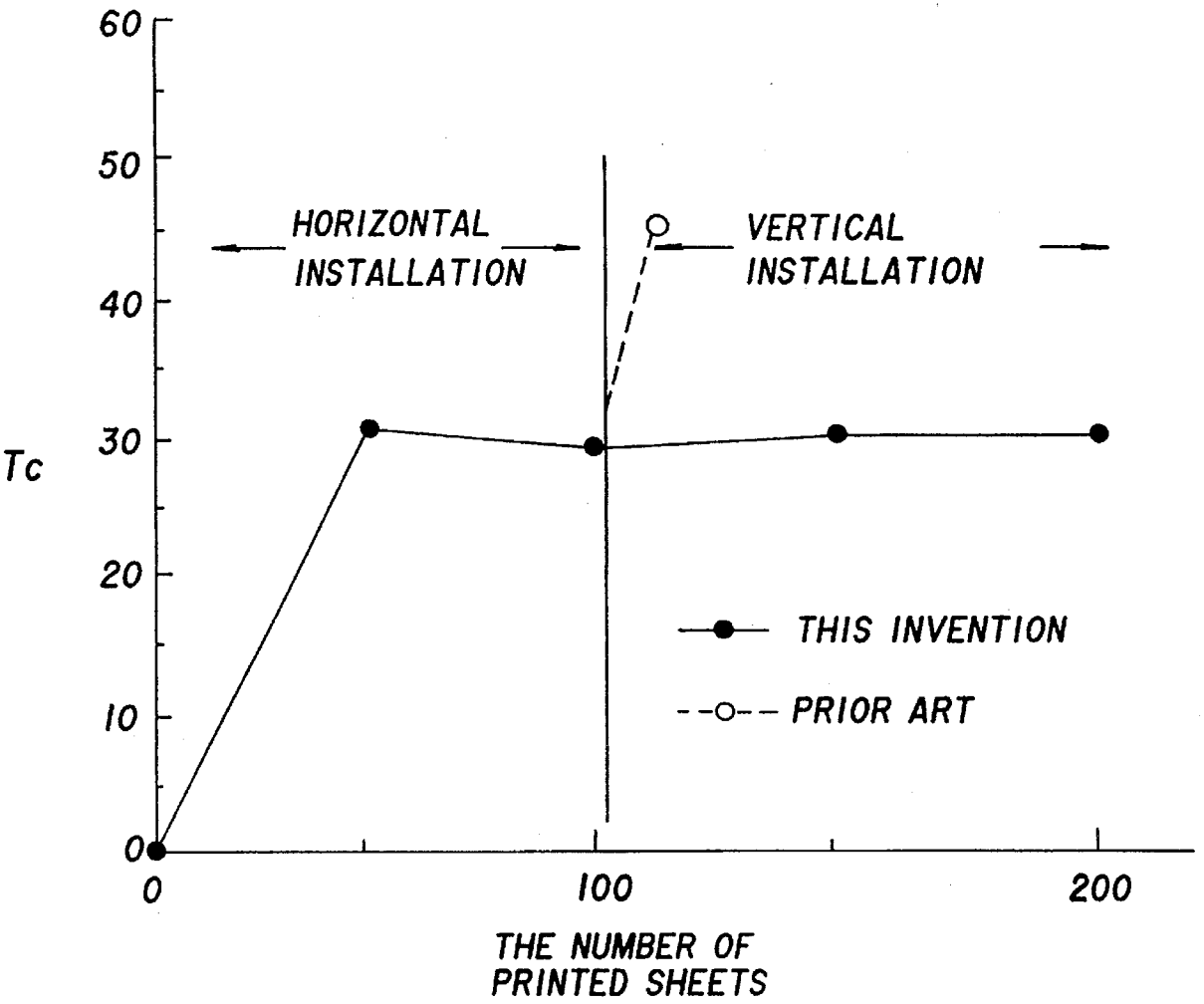
FIG. 9 is a characteristic diagram of the present invention.

FIG. 5 is a view illustrating a configuration of the developing unit of FIG. 2. FIG. 6 is a sectional view showing the principal elements of the developing unit of FIG. 5. FIG. 7 is a view showing a state of the vertical installation of the developing unit of FIG. 5. FIGS. 8A and 8B are views of assistance in explaining a toner supplying action. FIG. 9 is a characteristic diagram according to this invention.

As illustrated in FIG. 5, the developing roller 24 comprises a metallic sleeve 241 and a magnet 240 having plurality of magnetic poles and incorporated in the interior thereof. This developing roller 24, in which the magnet 240 in the sleeve 241 is fixed, serves to feed a magnetic developer, which will be mentioned later, with rotations of the sleeve 241. The developing roller 24 is 16 mm in diameter and rotates three times (75 mm/s) as fast as the peripheral speed of the photosensitive drum 20.

A developing chamber 230 is formed along the periphery of the developing roller 24. An interior of the developing chamber 230 is full of a 1.5-component developer as a mixture of the magnetic carriers and the magnetic toners. This developing chamber 230 is defined by an upper partition member 230-1 and a lower bottom 230-2 to have a fixed capacity.

With this arrangement, when a fixed amount of magnetic carriers (starter carriers) are put into the developing chamber 230, a quantity of the magnetic toners within the developing chamber becomes fixed. A quantity of the developer in this developing chamber 230 is fixed, and, therefore, a toner density becomes fixed when supplying the consumed magnetic toners from a toner hopper 231. Accordingly, the necessity for controlling the toner density can be eliminated. More specifically, the developing chamber is filled with the carriers having a quantity corresponding to a control point of the toner density, whereby the toner density is automatically controlled in a predetermined range.

Further, the circumferential area along the developing roller 24 is always full of the developer in this developing chamber. Hence, even when the apparatus is vertically placed, it is possible to prevent such a situation that the developer in the developing chamber 230 concentrates on one side enough not to supply the developer to the developing roller.

The magnetic carriers of the developer involve the use of magnetite carriers each having an average particle size on the order of 35 microns, while the magnetic toners involve the use of magnetic toners manufactured by use of the polymerization method but each having an average particle size of 7 microns. The polymerized toners are uniform in terms of particle size and sharp in particle size distribution. Therefore, an adhesion of the toner image on the photosensitive drum 20 to the sheet becomes uniform in the transfer process. For this reason, the electric field in the transfer unit also becomes uniform, and, hence, the transfer efficiency can be more enhanced than the toners based on the conventional pulverization method. The pulverized toners have a transfer efficiency of 60–90%, while the polymerized toners exhibit a transfer efficiency improved up to 90% or larger. The toner density is properly 5–60 wt %. In this embodiment, however, the toner density is set to 30 wt %.

A doctor blade 234 works to adjust the developer quantity supplied by the developing roller 24 to the photosensitive drum 20 so that the developer is not excessively supplied to the electrostatic latent image on the photosensitive drum 20 but does not reversely become short of supply. The adjustment is made with a gap between the edge of the doctor blade 234 and the surface of the developing roller 24. Normally, the gap is adjusted to approximately 0.1–1.0 mm.

The toner hopper 231 is filled with only the magnetic toners and incorporates a supply roller 232. Rotations of this supply roller 232 act to supply the toners to the developing chamber 230.

The toners supplied to the interior of this developing chamber 230 are stirred in the developing chamber 230 by dint of a developer feeding force of the sleeve of the developing roller 24, a magnetic force of the developing roller 24 and a developer regulating function of the doctor blade 234. Then, the toners rub against the carriers to be thereby charged to a predetermined polarity with a charging quantity. In accordance with this embodiment, a charging system between the carriers and the toners is adjusted with the result that the minus-charging takes place.

Further, as illustrated in FIG. 6, a spacing between the partition member 230-1 and the developing roller 24 is set smaller than a height of bristle of the magnetic brush formed above the developing roller 24 by use of the partition member 230-1 on the upstream side of the blade 234. Herein, as illustrated in FIG. 6, a spacing a is set to 2.0 mm. With this setting, the magnetic brush above the developing roller 24 is regulated by the partition member 230-1 and receives a force given by the rotations of the developing roller 24. A stirrability of the developer within the developing chamber 230 is thereby enhanced, and a stable toner charging quantity is obtained in a wide range of the toner density.

Further, this spacing is fixed along the periphery of the developing roller 24, with the result that the charging effect does not vary even when installed horizontally or vertically.

A toner supply passage 235 is defined by the top end of the above partition member 230-1 and the bottom 230-2 between the toner hopper 231 and the developing chamber 230. A width b of this toner supply passage 235 is, as shown in FIG. 6, 1.5 mm. The toners in the toner hopper 231 are fed via this toner supply passage 235 to the developing chamber 230.

The bottom 230-2 shaping this developing chamber 230 is provided with a protruded member 230-3 protruded into the toner hopper 231 in a position of the toner supply passage 235. Further, this bottom 230-2 is formed with an inclined surface extending upward from the side of the photosensitive drum 20. A spacing between the edge of this protruded member 230-3 and the edge of the partition member 230-1 is, as shown in FIG. 6, set such as c=1.0–1.5 mm. Namely, an inclination is given by this quantity. Further, a distance d between the edge of the partition member 230-1 and the developing roller 24 is set to 4.5–60 mm.

As illustrated in FIG. 5, an angle F made by two walls of this toner cartridge 25 and of the toner hopper 231 is set at approximately 45 degrees with respect to a direction-of-gravity G, and a direction of flow of the toners is set at 45 degrees. With this setting, as will be stated later, the toners can be smoothly supplied even when the apparatus is placed vertically.

Next, the operation of this developing unit will be explained. FIG. 5 illustrates a state of the developing unit when the apparatus shown in FIG. 3 is horizontally installed. The angle F made by the wall surfaces of the toner cartridge 25 and of the toner hopper 231 is set at about 45 degrees with respect to the direction-of-gravity G. Accordingly, the toners flow toward the bottom of the toner hopper 231 and are smoothly supplied to the supply roller 232.

In this horizontal installation, the toners have a fluidity toward the bottom in the toner hopper 231 because of the gravity. The supply roller 232 therefore scrapes up the toners on the bottom-side of the toner hopper 231. At this time, as illustrated in FIG. 8A, the toners pushed up the supply roller 232 once impinge on the partition member 230-1 because of the protruded member 230-3 of the bottom 230-2. The toners thereafter enter the toner supply passage 235.

With this arrangement, only the toners supplied by the toner supply roller 232 enter the toner supply passage 235. In this connection, the relevant portion of the partition member 230-1 serves as a buffer, and an intruding force by the toner supply roller 232 does not exert a direct influence on the toner supply passage 235. Hence, an excessive intrusion of the toners can be prevented, with the result that there are replenished the toners corresponding to an amount of shortage caused in the developing chamber 230.

In this case, the bottom 230-2 is inclined upward to the rotating direction of the developing roller 24. Therefore, the magnetic brush of the developing roller 24 and the carriers existing off this magnetic brush after passing through the photosensitive drum 20 do not leak into the toner supply chamber 231 from the toner supply passage 235 via the bottom 230-2. A reduction in the starter carriers in the developing chamber 230 can be thereby prevented. A stable 1.5-component phenomenon is attainable.

On the other hand, even in the state, illustrated in FIG. 7, of the developing unit when the apparatus shown in FIG. 4, the angle F made by the wall surfaces of the toner cartridge 25 and of the toner hopper 231 is set at about 45 degrees with respect to the direction-of-gravity G. Accordingly, even when installed vertically, the toners can be smoothly supplied to the supply roller 231.

At this time, as illustrated in FIG. 7, the toners stay about the partition member 230-1 on the side of the toner hopper 231 and are therefore easy to fall down into the developing chamber 230 from the toner supply passage 235. As shown in FIG. 8B, however, the protruded member 230-3 of the bottom 230-2 regulates the fall-down of the toners from the toner supply passage 235, and, therefore, almost no fall-down of the toners can be seen. Accordingly, it follows that the toners are supplied by the rotating force of the toner supply roller 232.

That is, as depicted in FIG. 8B, the toners pushed by the supply roller 232 once impinge on the partition member 230-1 because of the protruded member 230-3 of the bottom 230-2 and thereafter enter the toner supply passage 235. Consequently, only the toners supplied by the toner supply roller 232 enter the toner supply passage 235. In this connection, the relevant portion of the partition member 230-1 serves as the buffer, with the result that the intruding force given by the toner supply roller 232 does not directly turn out to be a toner supplying force. Accordingly, an excessive intrusion of the toners can be prevented. Only the toners corresponding to a quantity of shortage caused in the developing chamber 230 are replenished.

This implies no variation in terms of capability to supply the toners to the developing chamber even when the apparatus is horizontally installed or when installed vertically. It is therefore feasible to prevent variations in the image density because of no change in the toner density in the developing chamber even when the apparatus is horizontally placed or when vertically placed.

That is, the great majority of toners supplied to the developing chamber 230 are based on the toner supply roller 232. It is possible to attain the toner supply that is not influenced by the fluidity acting in the direction of gravity of the toners. For this reason, even if the installing direction of the apparatus changes, the toner supply quantity does not vary, and hence the stable developing operation can be done.

Further, when placed vertically, there exists a possibility of causing the fall-down of the developer from the developing unit 23. However, the developer involves the use of the magnetic two-component developer and is therefore retained on the developing roller 24 by the magnetic force. As a result, almost no fall-down of the developer takes place even when installing the apparatus vertically. Especially when using the magnetic carriers and the magnetic toners, both of the carriers and the toners are held on the magnet roller of the developing roller 24. Therefore, the fall-down of the developer can be prevented all the more, and the stable developing can be attained in the case of the above-mentioned vertical installation.

FIG. 9 is a characteristic diagram showing variations in toner density Tc when the printing is effected with the apparatus being installed longitudinally (vertically) after conducting the printing with the apparatus being installed laterally (horizontally).

To start with, the apparatus is placed horizontally. Then, a predetermined amount of starter carriers are put into the developing chamber 230 of the developing unit 23. The developing unit is then operated to effect the printing. As a result, the toners are gradually supplied to the developing chamber 230 from the toner hopper 231. The toner density therefore increases with an increment in the number of printed sheets. Subsequently, at the point of time when the developing chamber 230 is full of the carriers and the toners, the toner density becomes 30 wt %. Thereafter, no change can be seen in the toner density even when the number of the printed sheets increases.

Next, in this state, the printing is carried out by changing the apparatus into the vertical installation. As a consequence, the toner density is the same as that in the horizontal installation. According to the construction of the conventional 1.5-component developing unit disclosed in Japanese Patent Laid-Open Publication Number 3-252686, as indicated by a white circle in the Figure, when placed vertically, the toner density increases. The toner density changes with the result that the image density also varies depending on the horizontal installation and the vertical installation. This proves the above-stated action of stabilization of the toner supply. The image formation with no change in the image density can be thereby attained even when the apparatus is placed horizontally or when placed vertically. It is possible to actualize the image forming apparatus capable of being set both in the horizontal installation and in the vertical installation.

Given next is an explanation about the angle made by the wall surfaces of the toner cartridge 25 and of the toner hopper 231. In consideration of the vertical direction, the angle is properly 45°±15° to the direction-of-gravity. A good result is obtained when set preferably at 45°±5°.

Figure 10:
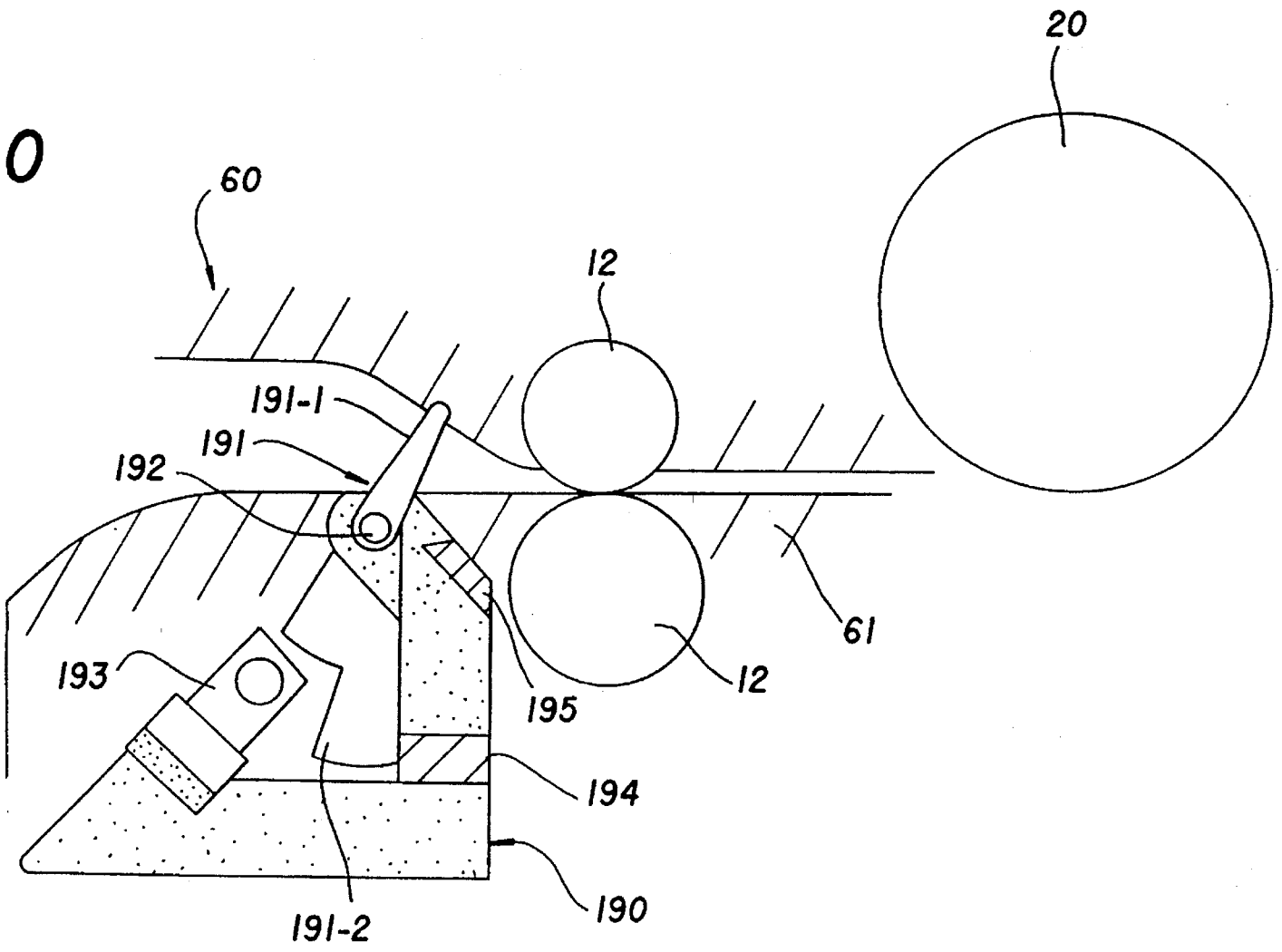
FIG. 10 is a view illustrating one embodiment of a sheet detector according to this invention.
Figure 11A:
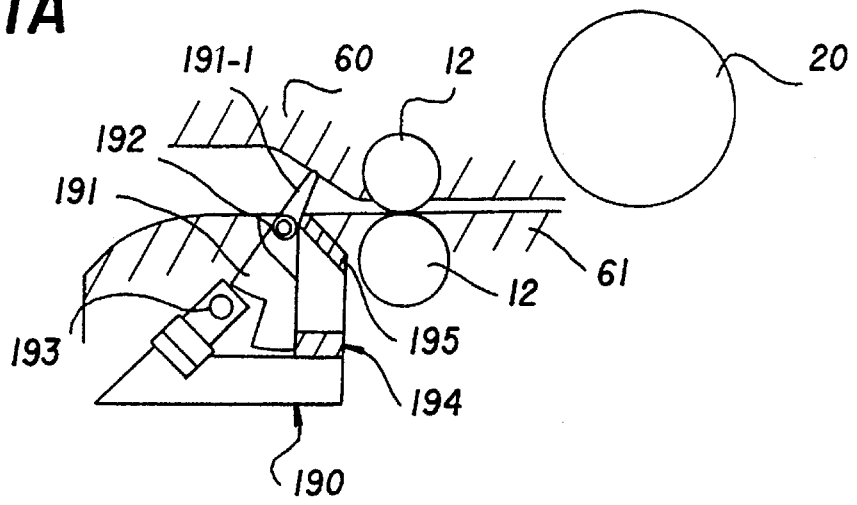
FIGS. 11A, 11B and 11C are views of assistance in explaining an operation when installed horizontally according to this invention.
Figure 11B:
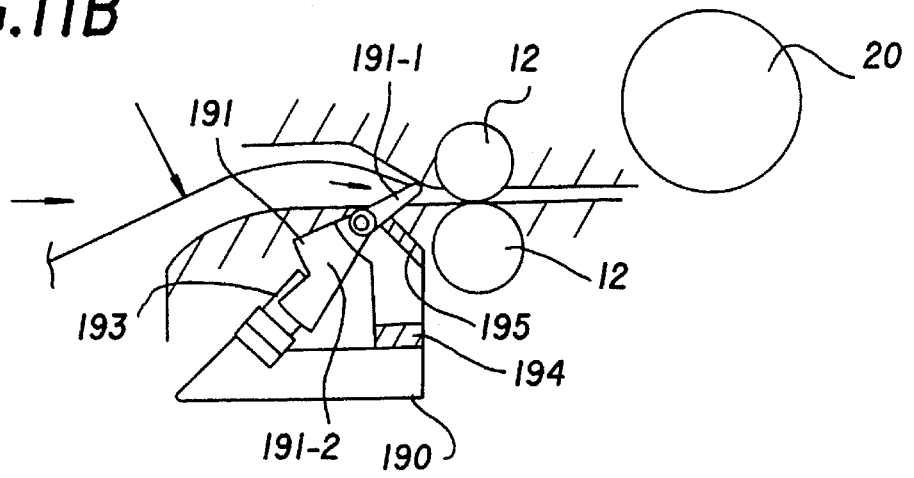
Figure 11C:
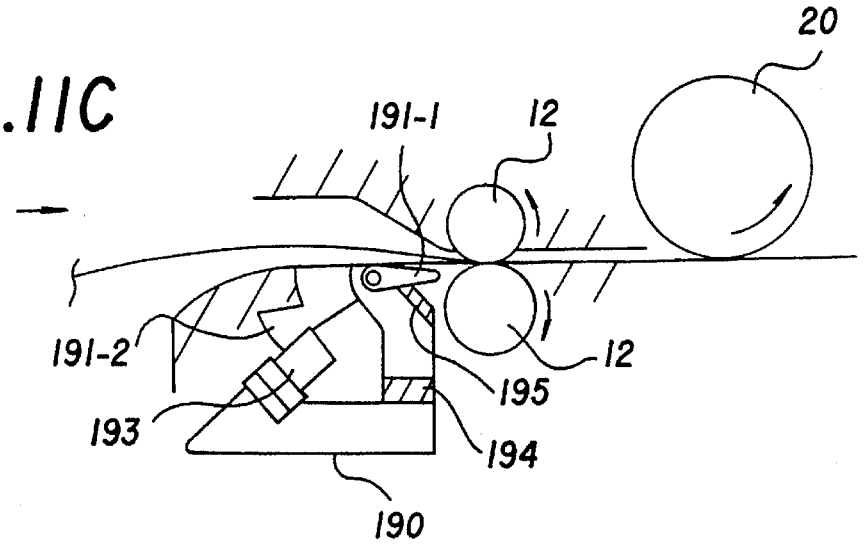
Figure 12A:
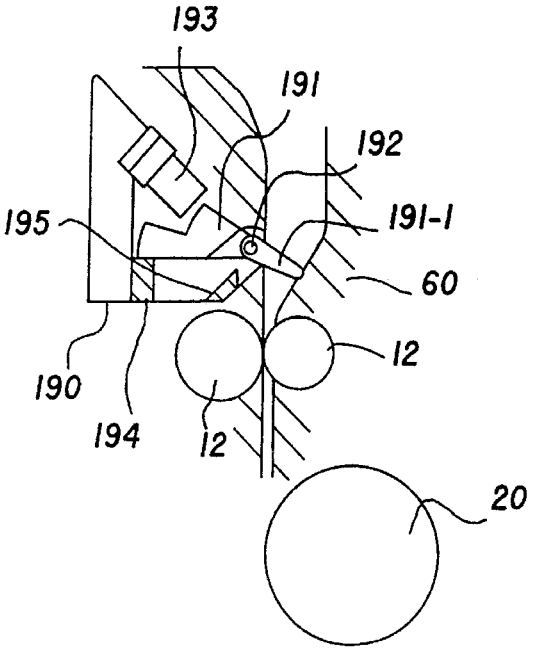
FIGS. 12B and 12C are views of assistance in explaining an operation when installed vertically according to this invention.
Figure 12B:
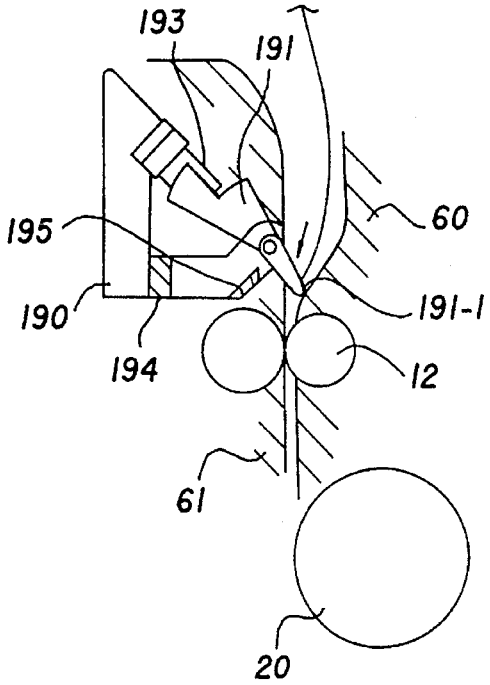
Figure 12C:
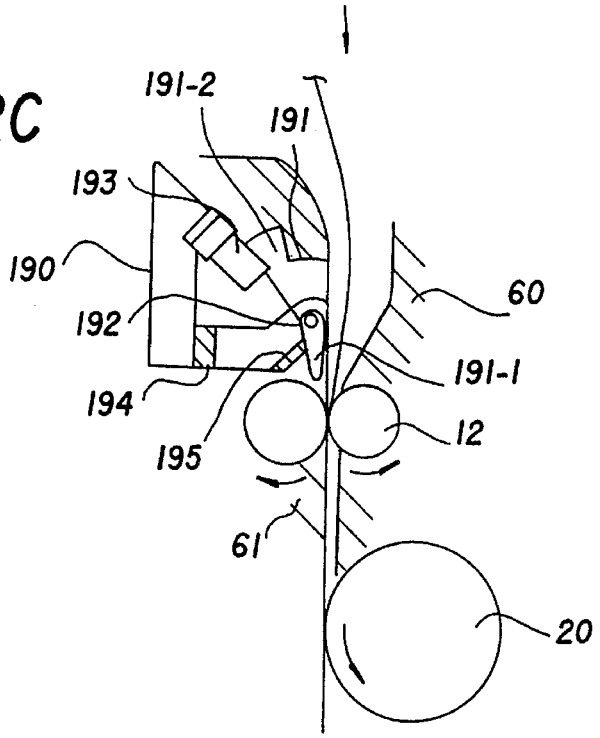
Figure 13:
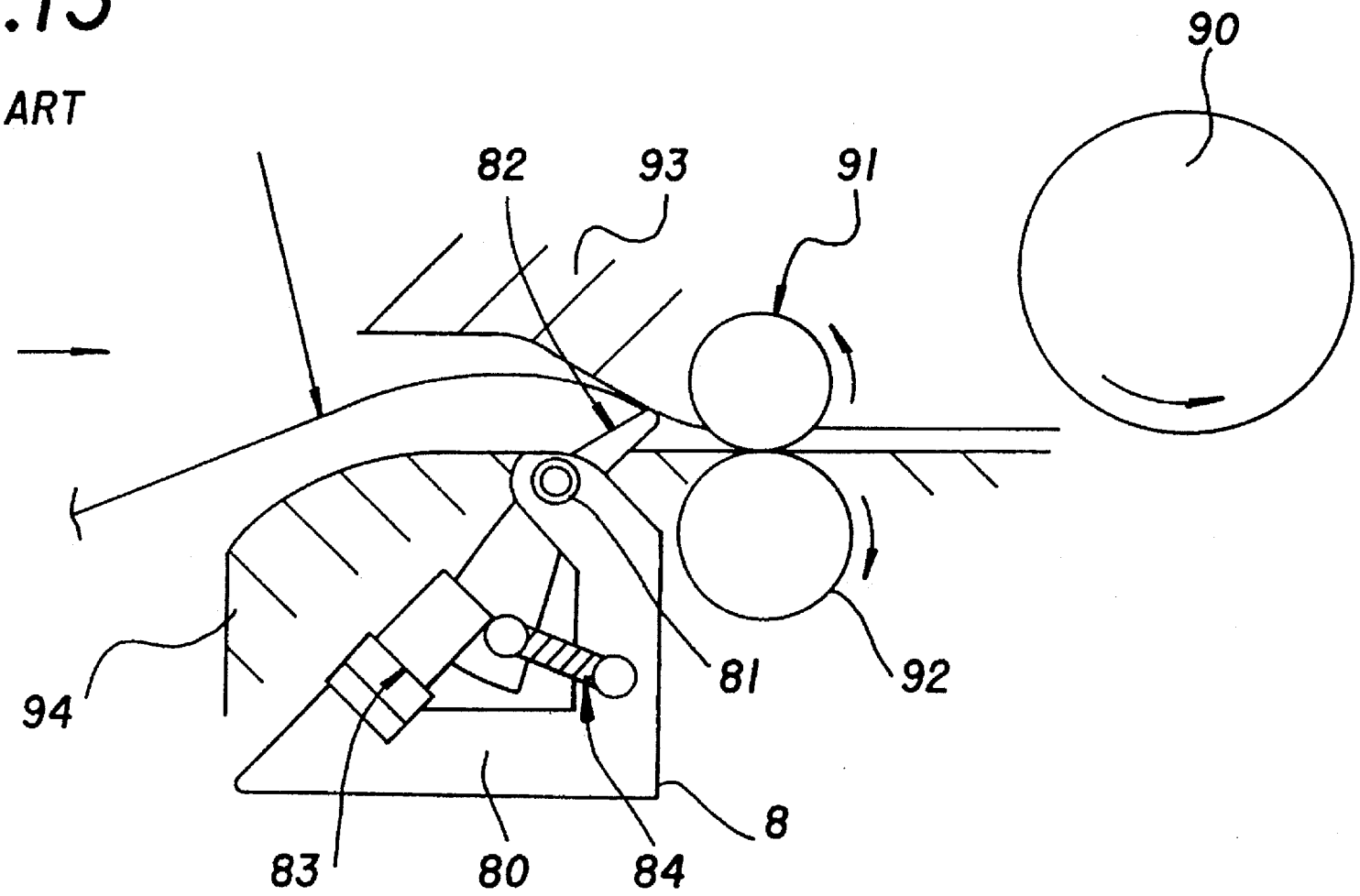
FIG. 13 PRIOR ART
FIG. 13 is an explanatory view of the prior art.

FIG. 10 is a view showing a configuration of the sheet detector in one embodiment according to the present invention. FIGS. 11A to 11C are views of assistance in explaining the operation when installed horizontally in the configuration of FIG. 10. FIGS. 12A to 12C are views of assistance in explaining the operation when installed vertically in the configuration of FIG. 10.

As illustrated in FIG. 10, the sheet passes through a feeding path formed between a couple of sheet guides 60. The above resist roller 12 is provided in this feeding path. The sheet detector 19 is disposed in front of the resist roller 12 on the feeding path. The sheet detector 19 is provided with a substantially reverse L-shaped holding block 190.

A detection lever 191 rotating about a rotary shaft 192 is secured to the top end of this holding block 190. The detection lever 191 includes a front edge 191-1 projecting into the feeding path and a rear edge 191-2 projecting on the side of the holding block 190. This detection lever 191 is, as explained in FIG. 1A, set so that the line connecting the center-of-rotation R to the center-of-gravity g has an angle of approximately 45° with respect to the direction-of-gravity.

Further, a transmission type sensor 193 is provided at the left end of the holding block 190. The transmission type sensor 193 includes a light emitting element and a light receiving element that are located in face-to-face relationship. An output of the sheet detection is given forth depending on whether or not the rear edge 191-2 of the detection lever 191 passes through a gap between the light emitting element and the light receiving element. Moreover, this holding block 190 comprises an impingement member (a first regulation member) 194 for regulating a position of the rear edge 191-2 of the detection lever 191 in a start-of-rotation position shown in the Figure. The holding block 190 also comprises a second regulation member 195 for regulating a position of the front edge 191-1 of the detection lever 191 in an end-of-rotation position.

The operation during the horizontal installation will be discussed with reference to FIGS. 11A, 11B and 11C. As illustrated in FIG. 11A, in a state where no sheet is prepared, the impingement member 194 impinges on the rear edge 191-2 of the detection lever 191 in the sheet detection 19. The front edge 191-1 thereof protrudes into the feeding path.

Next, as depicted in FIG. 11B, when the sheet is reached, the leading edge of the sheet pushes the front edge 191-1 of the detection lever 191, thereby rotating the detection lever 191 about the rotary shaft 192. With this action, the rear edge 191-2 of the detection lever 191 intercepts the transmission-type sensor 193, whereby the output of the sheet detection is generated. After a given time has elapsed since the output of the sheet detection was generated, the resist roller 12 is rotated, and the sheet is fed toward the transfer unit 26.

Further, as illustrated in FIG. 11C, the detection lever 191 is pushed by the sheet, while the front edge 191-1 of the detection lever 191 is regulated by the regulation member 195. The detection lever 191 does not rotate any more. The rear edge 191-2 of the detection lever 191 can be thereby prevented from protruding into the feeding path.

Then, when the sheet exits the resist roller 12, the detection lever 191 is released therefrom. The detection lever 191 is rotated by its self-weight in the reverse direction and stopped by the regulation member 194 of the lever holding block 190.

Further, the operation during the vertical installation will be explained with reference to FIGS. 12A to 12C. As illustrated in FIG. 12A, in the state where no sheet is prepared, the impingement member 194 impinges on the rear edge 191-2 of the detection lever 191 in the sheet detector 19. The front edge 191-1 thereof protrudes into the feeding path.

Next, as depicted in FIG. 12B, when the sheet is reached, the leading edge of the sheet pushes the front edge 191-1 of the detection lever 191, thereby rotating the detection lever 191 about the rotary shaft 192. With this action, the rear edge 191-2 of the detection lever 191 intercepts the transmission-type sensor 193, whereby the output of the sheet detection is generated. After a given time has elapsed since the output of the sheet detection was generated, the resist roller 12 is rotated, and the sheet is fed toward the transfer unit 26.

Further, as illustrated in FIG. 12C, the detection lever 191 is pushed by the sheet, while the front edge 191-1 of the detection lever 191 is regulated by the regulation member 195. The detection lever 191 does not rotate any more. The rear edge 191-2 of the detection lever 191 can be thereby prevented from protruding into the feeding path. Besides, the detection lever 191 is rotated by its self-weight, thus keeping an angle of rotation enough to return to the position before detecting the sheet.

Then, when the sheet exits the resist roller 12, the detection lever 191 is released therefrom. The detection lever 191 is rotated by its self-weight in the reverse direction and stopped by the regulation member 194 of the lever holding block 190.

As discussed above, the line connecting the center-of-rotation of the detection lever to the center-of-gravity is set at the angle of approximately 45° with respect to the direction-of-gravity. The sheet detection timing can be thereby set the same both in the horizontal installation and in the vertical installation. Further, the restoration spring is not required, and, therefore, the assembly is easy to attain.

In addition to the embodiments discussed above, the present invention can be modified in the following forms. First, in the embodiments discussed above, the developer involves the use of the 1.5-component developer composed of the combination of the magnetic carriers and the magnetic polymerized toners. As the magnetic toners, however, the magnetic pulverized toners may also be employed.

Second, only the sleeve rotates in the developing roller 24. However, the magnet also may be rotated. Third, the image exposure unit involves the use of the LED optical system. There may be, however, also employed a laser optical system, a liquid crystal shutter optical system and an EL (electroluminescence) optical system.

Fourth, the latent image forming mechanism has been explained in the form of the electrophotographic mechanism. However, a latent image forming mechanism (e.g., an electrostatic recording mechanism, etc.) for transferring the toner image may also be usable. The sheet is not confined to the paper but may involve the use of other mediums. Moreover, the photosensitive drum is not limited to the drum-like configuration but may take a belt-like shape.

Fifth, the printer has been explained by way of the image forming apparatus. However, other image forming apparatuses such as a copying machine, a facsimile, etc. may also be used. Sixth, the detecting element has been exemplified in the form of the transmission type photosensor. However, other sensors such as a magnetic sensor, etc. may also be used.

The present invention has been discussed so far by way of the embodiments. A variety of modifications may be effected within the range of the gist of the present invention but not eliminated from the scope of the present invention.

As discussed above, according to the present invention, the angle of the line connecting the center-of-rotation R of the detection lever 191 rotating about the rotary shaft to the center-of-gravity g is set at about 45° with respect to the direction-of-gravity. Therefore, the rotation moment M1 when apparatus is horizontally placed is substantially equal to the rotation moment M2 when vertically placed. Consequently, the resistance against the sheet feeding force when detecting the sheet becomes the same. The sheet detecting timing can be also set the same. It is therefore possible to detect the sheet at the same timing both in the horizontal installation and in the vertical installation. Further, the micro restoration spring is not needed, and hence the assembly is facilitated.

What is claimed is:

1. An image forming apparatus capable of operating to form an image both in a horizontal installation of said apparatus and in a vertical installation thereof, said apparatus comprising:

a rotary endless latent image carrier;

latent image forming means for forming a latent image on said latent image carrier;

developing means for developing the latent image on said latent image carrier with a powder developer;

transferring means for transferring the developed image on said latent image carrier onto a sheet fed via a feeding path; and sheet detecting means for detecting the sheet in the feeding path, said sheet detecting means having a detection level rotating about a rotary shaft, with a line connecting a center-of-rotation to a center-of-gravity being set at 40° through 50° with respect to a direction-of-gravity, and sensing means for detecting said detection lever, said detection lever arranged about said rotary shaft to be rotatable in a first direction due to a force exerted by the sheet fed via the feeding path and to be rotatable in a second direction, opposite the first direction due to the force of gravity only.

2. The image forming apparatus according to claim 1, wherein said detection lever has a front edge contacting the sheet and a rear edge detected by said detecting means.

3. The image forming apparatus according to claim 2, wherein said sheet detecting means includes a first regulation member for regulating a rotary position of said rear edge of said detection lever.

4. The image forming apparatus according to claim 3 wherein said sheet detecting means includes a second regulation member for regulating a rotary position of the front edge of said detection lever.

5. The image forming apparatus according to claim 4, further comprising a resist roller, provided in a rear stage of said sheet detecting means on the feeding path, for aligning the leading edges of the sheets and feeding the sheets toward said transferring means.

6. The image forming apparatus according to claim 4, further comprising a holding block, for holding said detection lever with the rotary shaft being centered, provided with said detecting means, said first regulation member and said second regulation member.

7. The image forming apparatus according to claim 3, further comprising a holding block, for holding said detection lever with the rotary shaft being centered, provided with said sheet detecting means and said first regulation member.

8. The image forming apparatus according to claim 3, further comprising a resist roller, provided at the rear stage of said sheet detecting means on the feeding path, for aligning the leading edges of the sheets and feeding the sheets toward said transferring means.

9. The image forming apparatus according to claim 2, wherein said sheet detecting means includes a second regulation member for regulating a rotary position of said front edge of said detection lever.

10. The image forming apparatus according to claim 4, further comprising a resist roller, provided in a rear stage of said sheet detecting means on the feeding path, for aligning the leading edges of the sheets and feeding the sheets toward said transferring means.

11. The image forming apparatus according to claim 4, further comprising a holding block, for holding said detection lever with the rotary shaft being centered, provided with said sheet detecting means and said second regulation member.

12. The image forming apparatus according to claim 2, further comprising a holding block, for holding said detection lever with the rotary shaft being centered, provided with said sheet detecting means.

13. The image forming apparatus according to claim 2, further comprising a resist roller, provided in a rear stage of said sheet detecting means on the feeding path, for aligning the leading edges of the sheets and feeding the sheets toward said transferring means.

14. The image forming apparatus according to claim 1, further comprising a resist roller, provided in a rear stage of said sheet detecting means on the feeding path, for aligning the leading edges of the sheets and feeding the sheets toward said transferring means.

15. The image forming apparatus according to claim 1, further comprising a holding block, for holding said detection lever with the rotary shaft being centered, provided with said sheet detecting means.

16. An image forming apparatus for performing an operation to form an image on a sheet, comprising:

a bottom portion serving as an installation surface for horizontally installing said apparatus;

a side surface portion serving as an installation surface for vertically installing said apparatus;

a rotary endless latent image carrier;

latent image forming means for forming a latent image on said latent image carrier;

developing means for developing the latent image on said latent image carrier with a powder developer;

transferring means for transferring the developed image on said latent image carrier onto a sheet fed via a feeding path; and sheet detecting means for detecting the sheet in the feeding path, said sheet detecting means having a detection lever rotating about a rotary shaft, with a line connecting a center-of-rotation to a center-of-gravity being set at 40° through 50° with respect to a direction-of-gravity and sensing means for detecting said detection lever, said detection lever arranged about said rotary shaft to be rotatable in a first direction due to a force exerted by the sheet fed via the feeding path and to be rotatable in a second direction, opposite the first direction, due to the force of gravity only.

17. An image forming apparatus capable of operating in horizontal and vertical orientations comprising:

a photosensitive drum for carrying a latent image;

an optical unit, for forming a latent image on said photosensitive drum;

a developing unit, for developing the latent image on said photosensitive drum;

a transfer unit, transferring the developed image on said photosensitive drum onto a sheet fed via a feeding path; and a detection lever, detecting the sheet in the feeding path, arranged about a rotary shaft to be rotatable in a first direction due to a force exerted by the sheet fed via the feeding path and to be rotatable in a second direction, opposite the first direction, due to the force of gravity only.

18. The image forming apparatus of claim 17, further comprising:

a sensor sensing a rotational position of said detection lever.

19. The image forming apparatus of claim 18, wherein said detection lever is constructed such that a line connecting a center-of-rotation of said detection lever to a center-of-gravity of said detection lever is set at 40° through 50° with respect to a direction-of-gravity.

20. The image forming apparatus according to claim 19, wherein said detection lever has a front edge contacting the sheet and a rear edge detected by said sensor.

21. The image forming apparatus according to claim 20, further comprising:

a first regulation member for regulating a rotary position of said rear edge of said detection lever; and a second regulation member for regulating a rotary position of said front edge of said detection lever.

22. The image forming apparatus according to claim 21, further comprising:

a resist roller, provided next to a downstream side of said detection lever on the feeding path, for aligning the leading edges of the sheets and feeding the sheets toward said transfer unit.

23. A sheet detector, detecting a sheet in a feeding path in a first orientation or in a second orientation at right angles to said first direction, the apparatus comprising:

a detection lever placed adjacent to the feeding path, rotating about a rotary shaft, with a line connecting a center-of-rotation to a center-of-gravity being set at 40° through 50° with respect to a direction-of-gravity, said detection lever arranged about said rotary shaft to be rotatable in a first direction due to a force exerted by the sheet fed via the feeding path and to be rotatable in a second direction, opposite the first direction, due to the force of gravity only; and a sensor, sensing a rotational position of said detection lever.

24. The sheet detector according to claim 23, wherein said detection lever has a front edge contacting the sheet and a rear edge detected by said sensor.

25. The sheet detector according to claim 24, further comprising:

a first regulation member for regulating a rotary position of said rear edge of said detection lever; and a second regulation member for regulating a rotary position of said front edge of said detection lever.

* * * * *